US010588416B2

(12) United States Patent
Vanmaastricht et al.

(10) Patent No.: US 10,588,416 B2
(45) Date of Patent: Mar. 17, 2020

(54) ADJUSTABLE CHAIR

(71) Applicants: Sue Vanmaastricht, Frankfort, MI (US); Bruce Albee, Middle Point, OH (US)

(72) Inventors: Sue Vanmaastricht, Frankfort, MI (US); Bruce Albee, Middle Point, OH (US)

( * ) Notice: Subject to any disclaimer, the term of this patent is extended or adjusted under 35 U.S.C. 154(b) by 0 days.

(21) Appl. No.: 16/021,073

(22) Filed: Jun. 28, 2018

(65) Prior Publication Data

US 2020/0000234 A1 Jan. 2, 2020

(51) Int. Cl.

| | |
|---|---|
| ***A47C 1/022*** | (2006.01) |
| ***A47C 1/023*** | (2006.01) |
| ***A47C 1/024*** | (2006.01) |
| ***A47C 7/44*** | (2006.01) |
| ***A47C 7/46*** | (2006.01) |
| ***A47C 7/14*** | (2006.01) |
| ***A47C 7/02*** | (2006.01) |

(52) U.S. Cl.

CPC ..... *A47C 7/14* (2013.01); *A47C 7/029* (2018.08); *A47C 7/462* (2013.01)

(58) Field of Classification Search

CPC ..... A47C 7/14; A47C 7/029; A47C 7/462

USPC ..... 297/284.7, 284.8, 300.1, 313, 314, 317, 297/318, 337, 338, 341, 342

See application file for complete search history.

(56) References Cited

U.S. PATENT DOCUMENTS

| | | | | | |
|---|---|---|---|---|---|
| 2,351,222 | A * | 6/1944 | Muskin | A47C 17/162 | 297/317 X |
| 3,337,266 | A * | 8/1967 | Burns | A47C 1/032 | 297/317 |
| 3,767,190 | A * | 10/1973 | Biggerstaff | A47C 1/034 | 297/318 X |
| 3,863,980 | A * | 2/1975 | Ciner | A47C 1/035 | 297/342 X |
| 4,362,336 | A * | 12/1982 | Zapf | A47C 7/46 | 297/317 |
| 4,452,486 | A * | 6/1984 | Zapf | A47C 1/032 | 297/317 |
| 4,504,090 | A * | 3/1985 | Goldman | A47C 1/03255 | 297/317 |
| 4,730,871 | A * | 3/1988 | Sheldon | A47C 7/462 | 297/284.7 |
| 5,112,106 | A * | 5/1992 | Asbjornsen | A47C 7/46 | 297/284.7 |
| 5,197,780 | A * | 3/1993 | Coughlin | A47C 7/465 | 297/284.4 X |
| 5,211,444 | A * | 5/1993 | Kjellman | A47C 1/0325 | 297/317 |

(Continued)

*Primary Examiner* — Rodney B White

(57) ABSTRACT

An adjustable chair with adjustable features to relieve the pressure on occupant's spine, tailbone, and pelvic bone when in sitting position. The adjustable chair includes a seat assembly and an adjustable support frame underlying the seat assembly with a plurality of legs and support casters. The seat assembly includes a backrest and a seat articulated together adjacent the lower edge of the backrest and rear edge of the seat. The automatic adjustable chair includes plurality of electrically motorized drive system to automate the various adjustable features. These drive systems are controlled by a single controller unit operable by the occupant from the sitting position.

6 Claims, 7 Drawing Sheets

(56) References Cited

U.S. PATENT DOCUMENTS 5,308,145 A * 5/1994 Koepke ..... A47C 1/03255 297/342 X
5,314,237 A * 5/1994 Koepke ..... A47C 1/03294 297/318
5,335,965 A * 8/1994 Sessini ..... A47C 7/425 297/284.4
5,494,332 A * 2/1996 Daniel ..... A47C 7/462 297/284.4
5,556,163 A * 9/1996 Rogers, III ..... A47C 1/023 297/337 X
5,567,011 A * 10/1996 Sessini ..... B60N 2/0232 297/284.4
5,577,803 A * 11/1996 Guilbaud ..... A47C 1/0244 297/338 X
5,871,258 A * 2/1999 Battey ..... A47C 1/023 297/317 X
6,033,021 A * 3/2000 Udo ..... A47C 9/002 297/313 X
6,059,362 A * 5/2000 Lin ..... A47C 7/425 297/284.4
6,193,313 B1 * 2/2001 Jonsson ..... A47C 1/023 297/337 X
6,488,335 B1 * 12/2002 Cioncada ..... A47C 1/032 297/300.1
6,629,731 B2 * 10/2003 Rogers ..... A47C 1/023 297/337 X
6,682,144 B2 * 1/2004 Klingler ..... B60N 2/6671 297/284.4
6,685,267 B1 * 2/2004 Johnson ..... A47C 1/023 297/300.1
6,824,219 B2 * 11/2004 Ruckstadter ..... A47C 1/03294 297/317
6,959,965 B2 * 11/2005 Diffrient ..... A47C 1/03 297/342 X
7,380,881 B2 * 6/2008 Freed ..... A47C 1/023 297/317
7,488,040 B2 * 2/2009 Dozsa-Farkas .... A47C 1/03255 297/317 X
8,550,558 B2 * 10/2013 Fu ..... A47C 1/03238 297/341 X
2002/0130541 A1 * 9/2002 Koo ..... A47C 3/026 297/284.7
2003/0107250 A1 * 6/2003 Staarink ..... A47C 7/402 297/284.7
2004/0135410 A1 * 7/2004 Udo ..... A47C 3/026 297/313
2005/0168030 A1 * 8/2005 Bykov ..... A47C 3/0252 297/312
2008/0231095 A1 * 9/2008 Brauning ..... A47C 7/38 297/284.4 X
2009/0115235 A1 * 5/2009 Bock ..... A47C 7/462 297/284.7
2009/0195040 A1 * 8/2009 Birkbeck ..... A47C 1/03255 297/317
2010/0213743 A1 * 8/2010 Jonsen ..... A47C 1/03255 297/342 X
2011/0084530 A1 * 4/2011 Lockwood ..... A47C 1/03294 297/342
2012/0062008 A1 * 3/2012 Rivera ..... A47C 1/03294 297/341
2012/0146376 A1 * 6/2012 Kang ..... A47C 7/402 297/284.7
2014/0103688 A1 * 4/2014 Wilson ..... A47C 1/03211 297/337
2015/0130241 A1 * 5/2015 Rivera ..... A47C 16/025 297/342
2015/0230607 A1 * 8/2015 Jang ..... A47C 1/024 297/342
2017/0290433 A1 * 10/2017 Reinhard ..... A47C 7/14
2018/0289167 A1 * 10/2018 Tedesco ..... A47C 7/14
2018/0317661 A1 * 11/2018 Lutwak ..... A61H 1/003

* cited by examiner

ADJUSTABLE CHAIR

CROSS REFERENCE TO RELATED APPLICATIONS

This application claims the benefit of U.S. Application No. 62/526,537 filed Jun. 29, 2017, which is incorporated herein in its entirety.

BACKGROUND

The present invention is directed to an adjustable chair which typically has a seat assembly, a backrest, and a support structure. An adjustable chair may have various adjustable features that can be modified by the occupant to fit the most comfortable sitting position. Adjustability includes tilting of a backrest relative to the seat and raising or lowering the seat. To achieve the most comfortable sitting position, the chair has to be adjustable to relieve the pressure on the occupant's spine, tailbone, and pelvic bone in sitting position. Adjusting the seat position would require the occupant to manually operate the individual mechanics of the adjustable parts of the chair. Thus, it would be desirable to have an automatic adjustable chair with electrically motorized drive system that is operable through a controller unit while in sitting position.

BRIEF SUMMARY OF THE INVENTION

One aspect of the invention relates to the adjustability of an adjustable chair to relieve the pressure on the occupant's spine, tailbone and pelvic bone in sitting position. The adjustable features include tilting of a backrest relative to a seat portion, sliding of a lumbar pad along a vertical structure of the backrest, shifting of the lumbar pad perpendicular from the vertical structure of the backrest, sliding of a seat pad along a horizontal structure of the seat portion, and independent height adjustability of the front and rear regions of the chair. A constant gap is maintained between the hinge point and the seat. This results in the majority of the occupant's weight being supported by the occupant's thigh and upper back which eliminates the pressure point between the occupant's buttocks and the seat.

Another aspect of the invention relates to an automatic adjustable chair with electrically motorized drive system. The automatic adjustable chair includes a plurality of electrically motorized drive systems to automate the various adjustable features. These drive systems are controlled by a single controller unit operable by the occupant from the sitting position.

DETAILED DESCRIPTION

Figure 1:
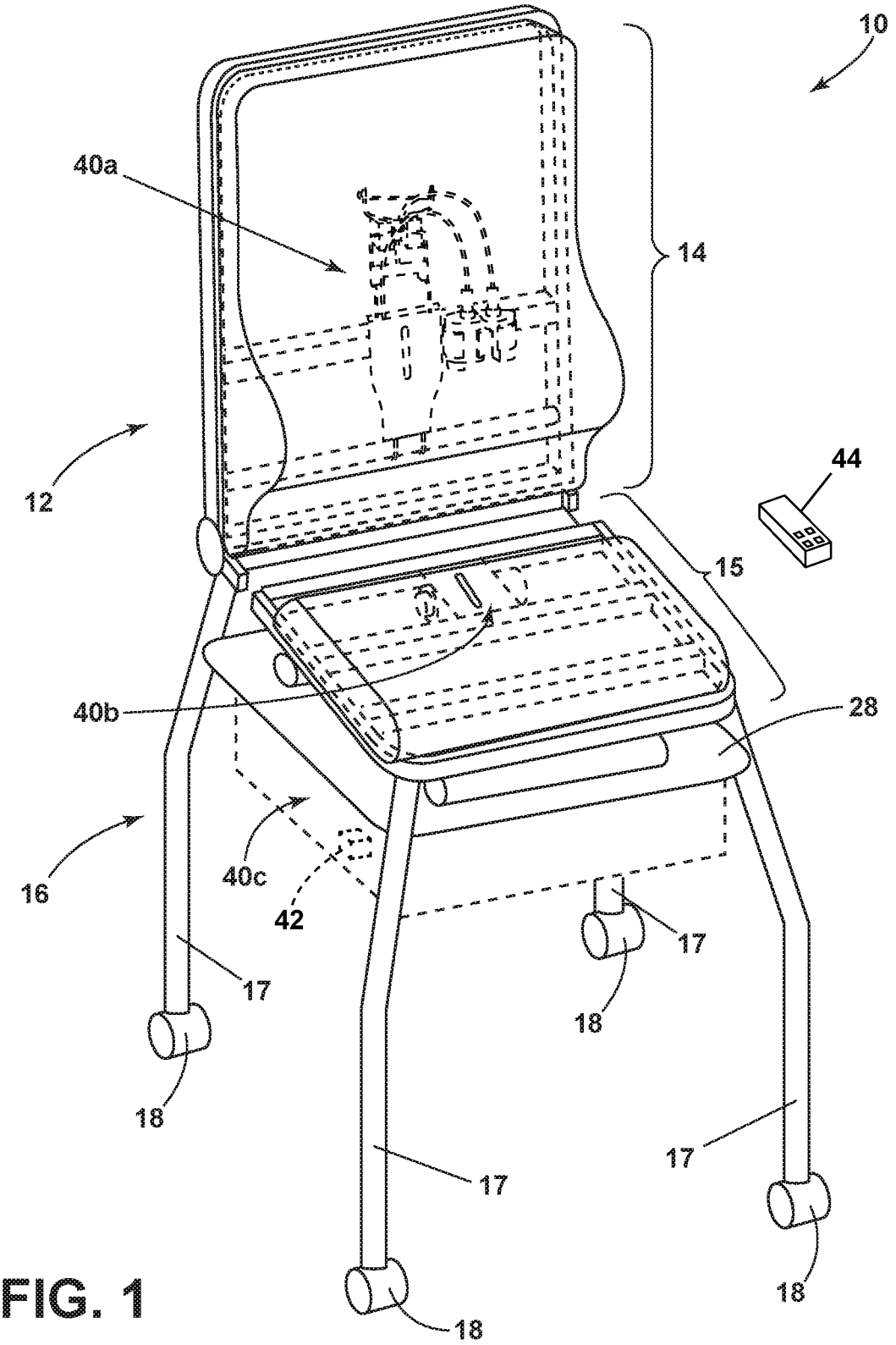
FIG. 1 is a perspective view of an adjustable chair according to the present invention.

FIG. 1 shows an automated adjustable chair 10 which embodies the features of the present invention. The chair includes a seat assembly 12 comprising a backrest 14 and a seat 15 articulated together adjacent the lower edge of the backrest 14 and rear edge of the seat 15. An adjustable support frame 16 underlying the seat 15 is formed with a plurality of legs 17 and support casters 18. A plurality of electrically motorized drive systems 40*a, b*, and *c* operated by a controller unit 42 may be utilized to automate the various adjustable features of the chair 10 in the present invention. The controller unit 42 may disposed at any convenient location in the chair, and may have a wired or wireless remote controller 44 coupled with it wherein a user can operate the controller and the chair using the remote. Thus, a user sitting in the chair, for example, can operate the remote 44 to actuate any or all of the drive systems 40*a, b*, and *c*.

Figure 2:
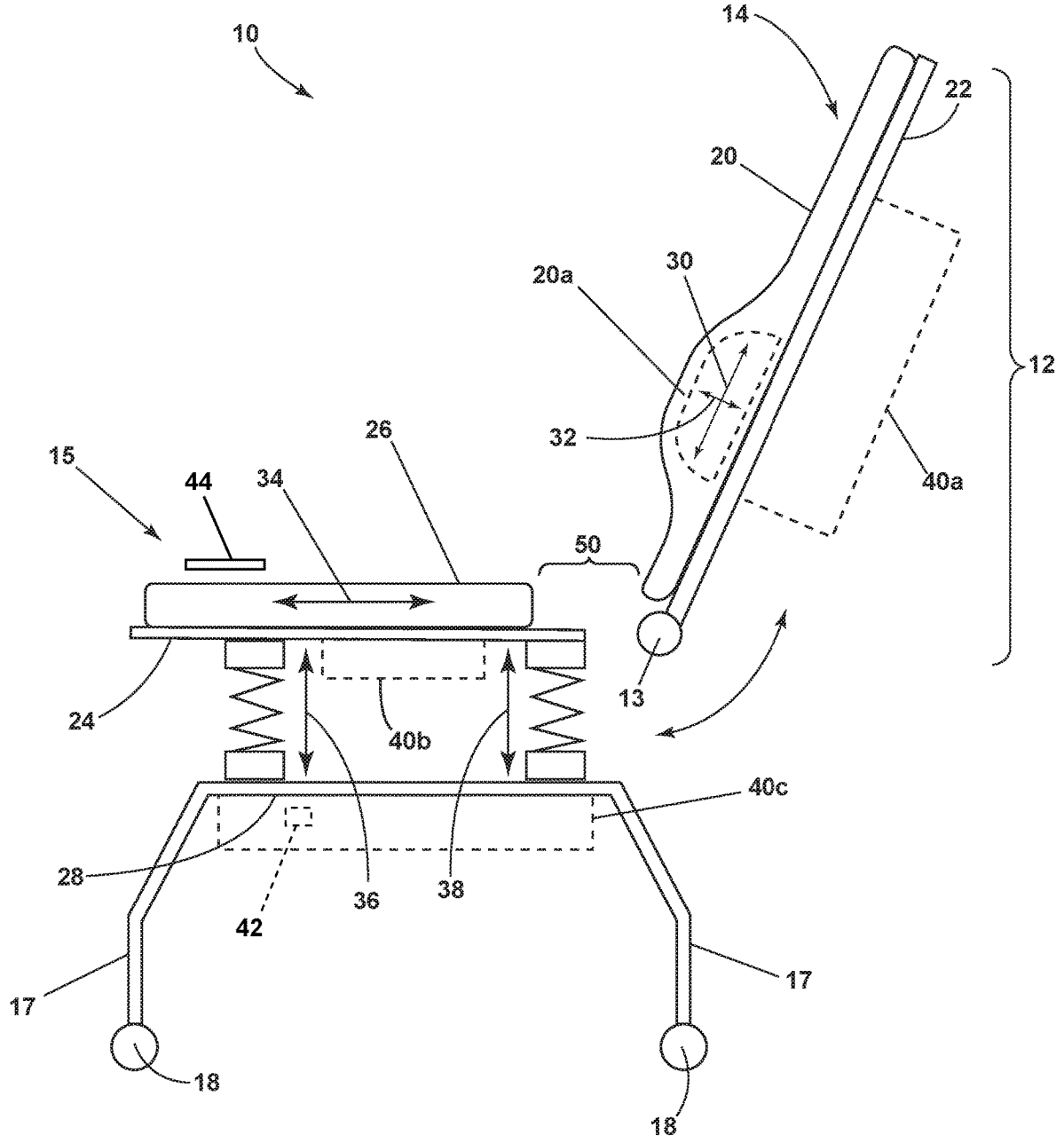
FIG. 2 is a schematic representation of the adjustable chair of the present invention.

The functional operation and adjustable features of the adjustable chair 10 are best shown in the schematic illustration of FIG. 2. The backrest 14 and seat 15 are supported by a support frame 16. The backrest 14 and seat 15 are articulated together at hinge point 13.

Figure 3:
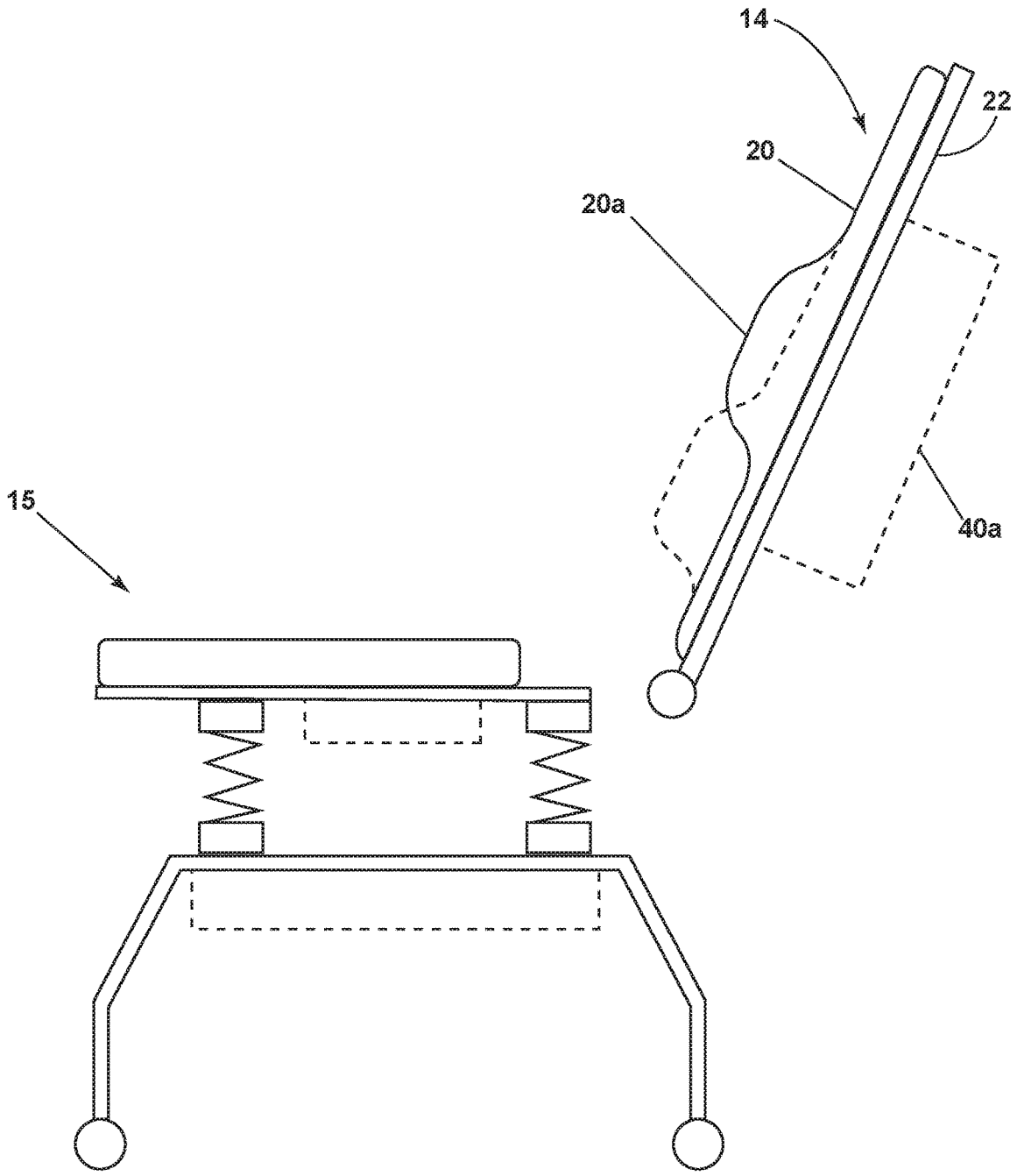
FIG. 3 is a schematic view of the chair of the present invention illustrative of the lumbar pad vertical adjustability.
Figure 4:
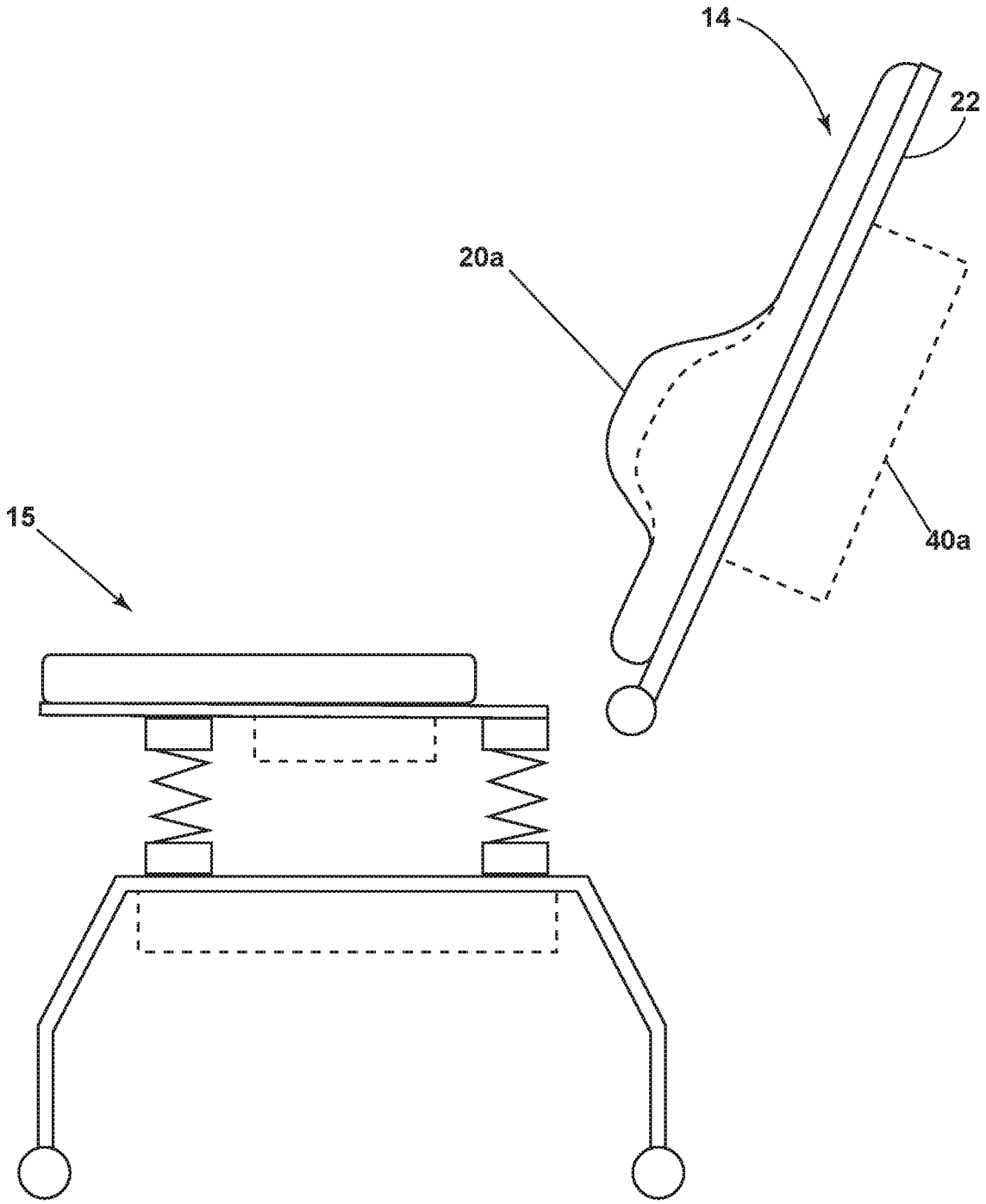
FIG. 4 is a schematic view of the chair of the present invention illustrative of the lumbar pad horizontal adjustability.

Referring to FIGS. 2, 3, and 4, the backrest 14 includes a vertical support structure 22 and a back pad 20 with an integrated adjustable lumbar pad 20*a*. The adjustable lumbar pad 20*a* is illustrated as being curved from top to bottom with the forwardmost portion of the curve being adjustable along the path of travel vertically 30 and horizontally 32. As shown in FIG. 3, the adjustable lumbar pad 20*a* can be automated to slide up and down along the vertical support structure 22 within the back pad 20 via a drive system 40*a* integrated into the vertical support structure 22. As shown in FIG. 4, the lumbar pad 20*a* can also be automated to shift forward or backward perpendicular to the vertical support structure 22 via the same drive system 40*a*.

Figure 6:
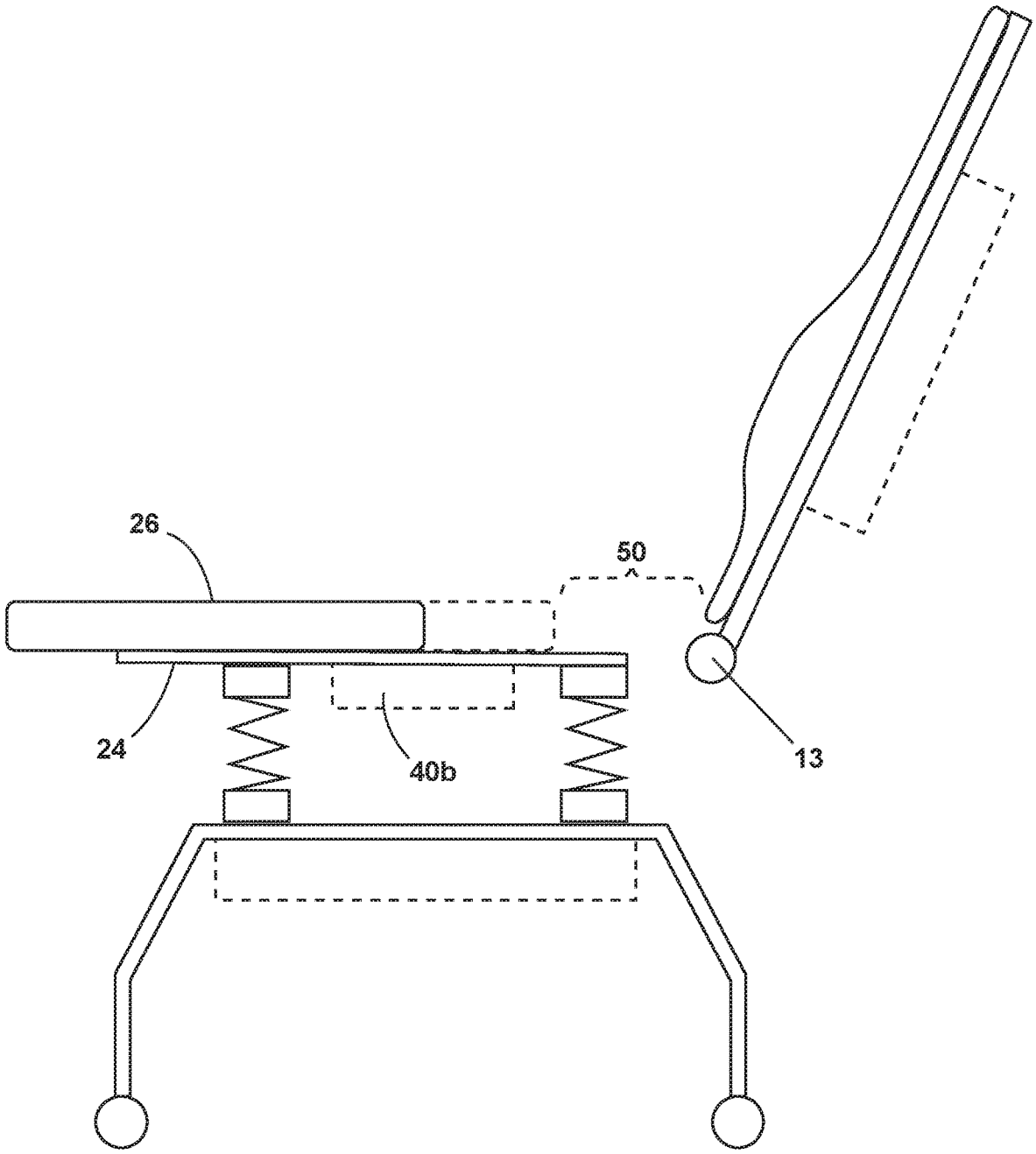
FIG. 6 is a schematic view of the chair of the present invention illustrative of the seating pad horizontal adjustability.

Further, as shown in FIG. 2, the seat 15 includes a horizontal base structure 24 with adjustable seating pad 26 along the path of travel 34. The adjustable seating pad 26 can be automated to slide forward and backward along the horizontal base structure 24 via the drive system 40*b* as illustrated in FIG. 6. A gap 50 is maintained between the hinge point 13 and the seating pad 26 can be shifted backward.

Figure 7:
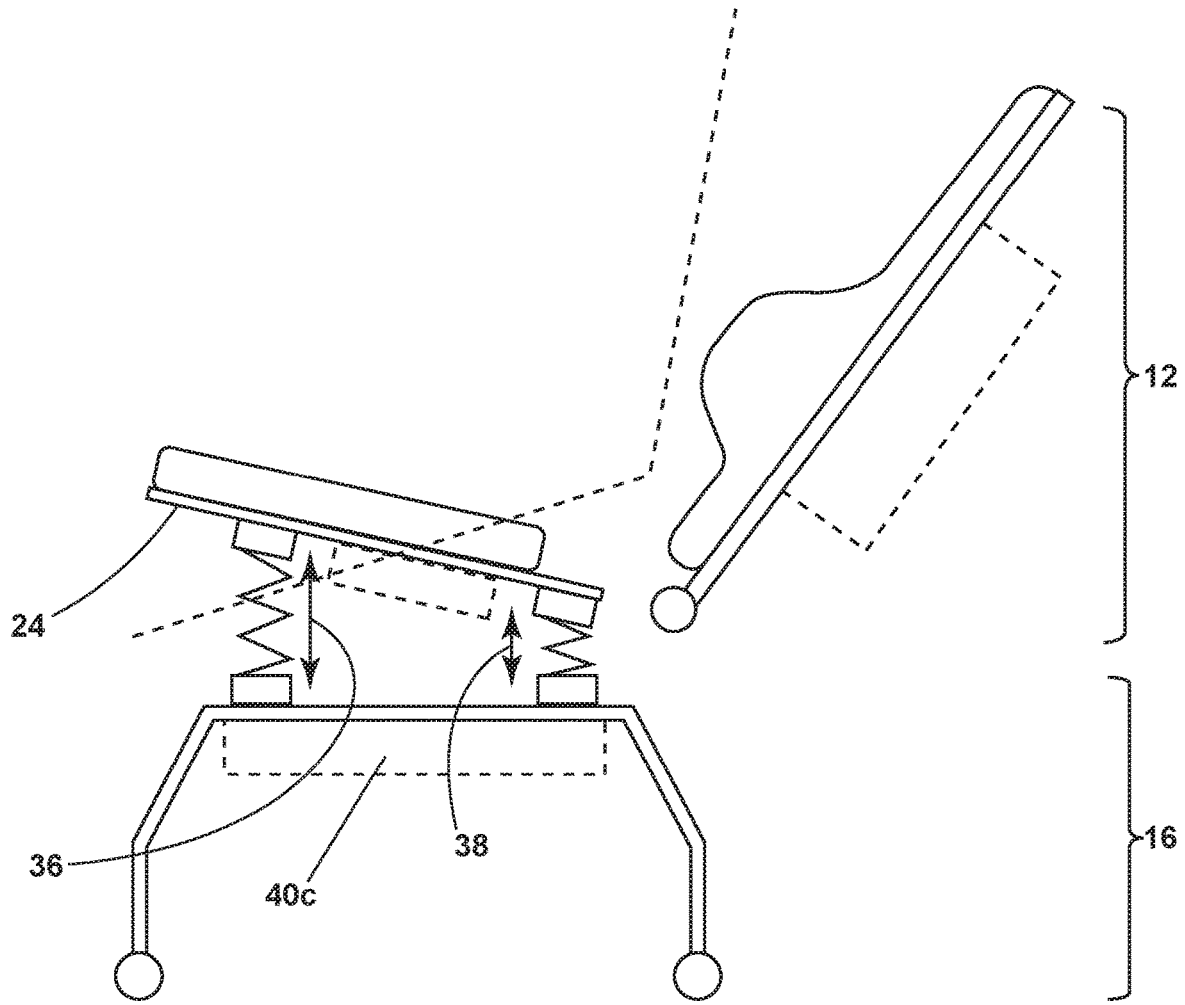
FIG. 7 is a schematic view of the chair of the present invention illustrative of the seat assembly independent vertical adjustability.

Referring to FIGS. 2 and 7, the horizontal base structure 24 can be automated by the drive system 40*c* to provide vertical adjustment of the seat assembly 12 by raising or lowering the base structure 24 relative to the support frame 16. In this regard, it is envisioned that the base structure 24 can be vertically adjusted independently between the front 36 and rear 38 regions by having an independent drive system for the different regions as illustrated in FIG. 7.

Figure 5:
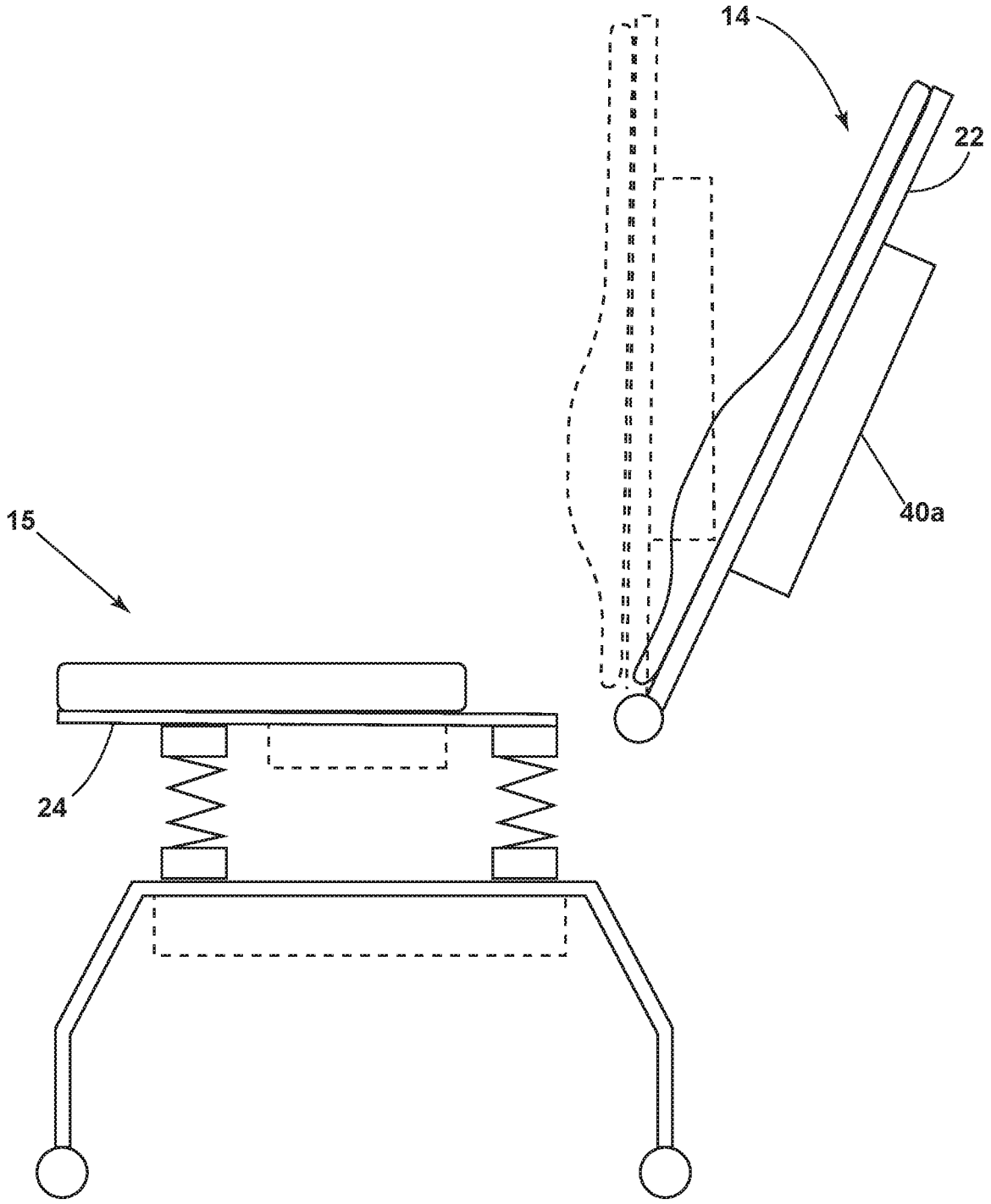
FIG. 5 is a schematic view of the chair of the present invention illustrative of the backrest tilting feature.

As shown in FIGS. 2 and 5, the backrest 14 and seat 15 are articulated separately at hinge point 13 between the vertical support structure 22 and the base structure 24 to allow the backrest 14 to tilt rearward or forward. The tilting feature can be automated by the same drive system 40*a* integrated with the vertical support structure 22.

Referring to FIGS. 1 and 2, the support frame 16 comprises of a rectangular steel frame 28 with at least four legs 17 extending downward from the corners of the frame 28. A conventional caster 18 is affixed to the free end of each leg 17 to support the weight of the chair 10. Additional compartments can be affixed to the bottom of the support frame 16 to house a controller unit 42, power supply (not shown) and the drive system 40*c* responsible for independent vertical adjustment of the front 36 and rear 38 regions of the seat assembly 12. The drive system 40*c* will house the point of connection between the seat assembly 12 and the support frame 16.

The features of the chair 10 that reduce the pressure on the occupant's spine, tailbone, and pelvic bone while in sitting position will be described in detail with references to FIGS. 3 through 7.

Referring to FIGS. 3 and 4, the adjustability of the lumbar pad 20*a* accomplishes several advantages. First of all, the vertical adjustability of the lumbar pad 20*a* is designed to support the lumbar region of occupants with varying height. Secondly, the horizontal adjustability is designed for occupants with different spine curvature as well as to maintain the support on their lumbar region despite the horizontal or vertical changes in the sitting position.

Referring to FIG. 5, the tilting feature of the vertical support structure 22 relative to the base structure 24 allows the occupant to control the magnitude of the weight of the upper body to be supported by the curve of the lumbar pad 20*a*. The adjustable lumbar pad 20*a* in combination with the tilting feature supports the upper body of the occupant to reduce the pressure on their spine, tailbone, and pelvic bone.

As shown in FIG. 6, a gap 50 is maintained between the hinge point 13 and the maximum extended seating pad 26 can be shifted backward without contacting the hinge point 13. This feature is unique to the present invention as it further alleviates the overall pressure on the occupant's lumbar region by eliminating the pressure point between the occupant's buttock and the seat. With the seating pad 26 located slightly towards the front of the seat 15, the majority of the occupant's weight will be supported by the occupant's thigh and the upper back depending on the tilting angle of the backrest 14.

With the backrest 14 tilted backward, the change in pressure exerted by the weight of the upper body relative to the occupant's thigh will have a tendency to cause the occupant to slide forward. As shown in FIG. 6, the horizontal adjustability of the seating pad 26 along the base structure 24 compensates for the shifting pressure on the thigh of the occupant when the backrest 14 is tilted backward. The adjustability of the seating pad 26 also accommodates occupants of varying heights in order to position the seating pad 26 below the thigh region.

Referring to FIG. 7, the independent vertical adjustability of the front and rear regions of the base structure 24 relative to the support frame 16 allows for greater flexibility in the height adjustment and tilting position of the overall seat assembly 12. For example, when the backrest 14 is tilted backward and the seating pad 26 has been shifted forward to accommodate the shifting pressure, it may be desirable to raise the front region of the base structure 24 higher than the rear region in order for the seat assembly 12 to have a slight tilt backward. This feature will ensure that the overall pressure from the occupant's body weight is consistently applied close to the center of the chair 10, thus preventing the occupant from sliding off the seating pad 26 when the backrest 14 is tilted backward.

While the adjustable features of the seat assembly 12 have been explained in great detail, the automation of these features through the use of electrically motorized drive systems 40*a, b*, and *c* is unique to the present invention. As the occupant is able to control the adjustable features of the chair 10 via a controller unit, adjustments to achieve the most comfortable position can be done with the operation of the controller while the occupant is in seating position. This allows the occupant to instantly feel the changes from the varying adjustments made to the seating position without having to manually adjust different parts of the seat assembly 12.

While the chair of the present invention has been described in detail above, it is apparent that various changes and modifications might be made without departing from the scope of the present invention, which is set forth in the following claims.

The invention claimed is:

1. An adjustable chair comprising a backrest and a seat articulated together at a hinge point, the backrest including a vertical support structure that tilts about the hinge point and a lumbar support adjustable vertically and horizontally, and the seat including a seat pad and base structure, the seat pad being adjustable horizontally relative to the base structure and the hinge point with a gap between the seat pad and the hinge point, and the base structure having front and rear portions, each of the front and rear portions being independently adjustable vertically, so that as the vertical support structure tilts, the seat pad is adjusted horizontally away from the hinge point to maintain position of the seat pad below a thigh region of a person sitting on the adjustable chair wherein the gap is maintained between the seat pad and the hinge point regardless of the tilt of the vertical support structure so that an occupant's buttocks can remain in the gap and avoid a pressure point at the buttocks.

2. The adjustable chair of claim 1 further comprising at least one motorized drive system connected to the vertical support structure and to the seat pad to cause the vertical support structure, the seat pad, the lumbar support, and the front and rear portions to move.

3. The adjustable chair of claim 2 wherein the backrest includes a drive system integrated into the vertical support structure.

4. The adjustable chair of claim 2 wherein the at least one motorized drive system includes a drive system integrated into the base structure to urge the seat pad to adjust horizontally.

5. The adjustable chair of claim 2 wherein the at least one motorized drive system includes a drive system integrated into the base structure to urge the front and rear portions to independently adjust vertically.

6. The adjustable chair of claim 2 further comprising a remote controller operably connected to the at least one motorized drive system.

* * * * *